US008627518B1

(12) United States Patent
Lederer et al.

(10) Patent No.: US 8,627,518 B1
(45) Date of Patent: Jan. 14, 2014

(54) PORTABLE TOILET

(71) Applicants: Eugene G Lederer, Los Angeles, CA (US); Ralph E White, Redondo Beach, CA (US)

(72) Inventors: Eugene G Lederer, Los Angeles, CA (US); Ralph E White, Redondo Beach, CA (US)

(73) Assignee: Eugene G. Lederer, Los Angeles, CA (US)

( * ) Notice: Subject to any disclaimer, the term of this patent is extended or adjusted under 35 U.S.C. 154(b) by 0 days.

(21) Appl. No.: 13/663,413

(22) Filed: Oct. 29, 2012

(51) Int. Cl.
*E03D 11/00* (2006.01)

(52) U.S. Cl.
USPC ..... 4/438; 4/441; 4/442; 4/466; 4/471

(58) Field of Classification Search
USPC ..... 4/438, 441, 442, 449, 466, 471, 484, 4/480
See application file for complete search history.

(56) References Cited

U.S. PATENT DOCUMENTS

| | | | | |
|---|---|---|---|---|
| 888,643 | A * | 5/1908 | Naviokus | 4/471 |
| 3,457,567 | A * | 7/1969 | Criss | 4/484 |
| 4,031,575 | A | 6/1977 | Landsberger | |
| 5,852,832 | A | 12/1998 | Voigt et al. | |
| 6,000,068 | A | 12/1999 | Chavis | |
| 6,006,369 | A * | 12/1999 | Bly | 4/236 |
| 6,263,521 | B1 | 7/2001 | Pi | |
| 6,341,386 | B1 | 1/2002 | Phillips et al. | |
| 6,782,565 | B2 | 8/2004 | Hinton | |

* cited by examiner

*Primary Examiner* — Tuan N Nguyen
(74) *Attorney, Agent, or Firm* — Mark W Handley

(57) ABSTRACT

A portable toilet (12) is provided having a bowl (14), a seat (16), legs (20), and wheels (28) mounted to the legs (20). The legs (20) are spaced apart and telescopically extensible to allow positioning of the bowl (14) above a conventional building toilet (60). The bowl (14) has a lower end (48) defined by sections (50) which pivot to open the bowl (14) and allow the contents to spill therefrom into the conventional toilet (60). A liner (34) fits in the bowl (14) and is held in place by the seat (16). The bowl (14) is placed over the conventional building toilet (60), the lower end (48) of the bowl is opened, the seat (16) is raised, and then the liner (34) and its contents fall through the open lower end (48) of the bowl (14) and into the conventional toilet (60).

15 Claims, 8 Drawing Sheets

PORTABLE TOILET

TECHNICAL FIELD OF THE INVENTION

The present invention relates in general to portable toilets, and in particular to a portable toilet for bedside use which provides for easy cleaning by care givers.

BACKGROUND OF THE INVENTION

Prior art portable toilets which have been provided for bedside use are typically cleaned by an attendant or care giver, usually requiring the emptying of pans or bowls. In hospitals a portable toilet has been provided by a bench having a hole in the seat for receipt of a bowl used for receiving waste. After use, the bowl must be removed, emptied, and then cleaned by the attendant or care giver. Portable toilets have also been provided by chairs or stools having a hole in the seat for receiving a receptacle bag which is disposed of after use, requiring the attendant or the care giver to remove the bag for disposal. An alternative is desired which reduces the need for an attendant or a care giver to handle waste for disposal.

SUMMARY OF THE INVENTION

A portable toilet is provided having a bowl, a seat, and legs. The seat is pivotally mounted to the bowl. The legs are telescopically extensible to allow positioning of the height of the bowl and wheels are mounted to the lower ends of the legs. The legs are spaced apart for fitting on opposite sides of a conventional building toilet and placing the bowl above the conventional toilet. The bowl has a lower end defined by sections which pivot to fully open the lower end of the bowl and allow the contents of the bowl to spill therefrom into the conventional toilet. A liner fits in the bowl and is held in place by the seat. After use, the portable toilet is positioned above the conventional building toilet, the sections are moved to open the lower end of the bowl, and then the seat is lifted to release the liner to fall through the open lower end of the bowl and into the conventional building toilet. Preferably, linkages are connected to a handle which is pulled moving the sections to open the lower end of the bowl and the seat is raised to release the liner and waste to fall from the portable toilet into the building toilet.

DESCRIPTION OF THE DRAWINGS

For a more complete understanding of the present invention and the advantages thereof, reference is now made to the following description taken in conjunction with the accompanying Drawings in which

FIG. 1 is a perspective views of the portable toilet with the seat in a downward position;

FIG. 2 is a partially exploded, perspective view of the portable toilet and a liner for fitting within the bowl;

FIG. 3 is a partial cutaway, side elevation view of the portable toilet being positioned above a conventional building toilet showing the seat raised and the lower end of the bowl in an open position for disposal of the contents of the bowl;

FIG. 4 is a side elevation view of the bowl showing a pull handle and control linkages for opening and closing the lower sections of the bowl with the bowl sections shown in open positions;

FIG. 5 is a side elevation view of the bowl and control linkages and FIG. 6 is a top view of the control linkages for opening and closing the lower sections of the bowl in response to opening and closing the seat for the portable toilet;

FIG. 7 is a sectional view of mating sections of the lower end of the bowl, shown in closed positions;

FIG. 8 is a side elevation view of the lower sections of the bowl connected to rotary sprockets and belts for opening and closing the lower sections of the bowl in response to opening and closing the seat for the portable toilet;

FIG. 9 is a partially exploded sectional view and FIG. 10 is an exploded partial view of the legs and locks for simultaneously controlling telescopic extension and retraction of the legs; and FIG. 11 is a schematic diagram of a control mechanism for operating the locks for simultaneously controlling release of the legs for extension and retraction.

DETAILED DESCRIPTION OF THE INVENTION

Figure 1:
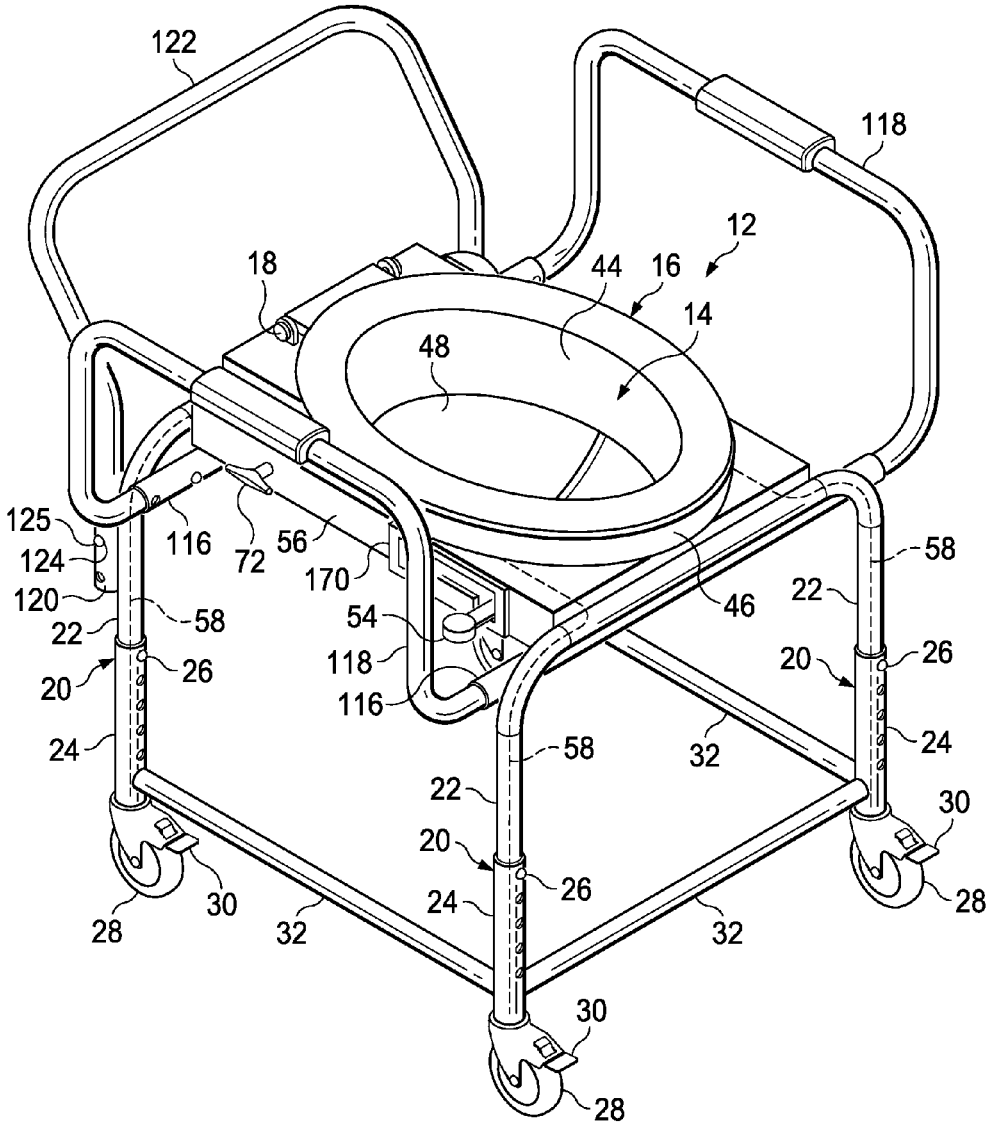
FIGS. 1 through 11 show various aspects for a portable toilet made according to the present invention, as set forth below.

FIG. 1 is a perspective view of the portable toilet 12 having a bowl 14 and a seat 16. The seat 16 is preferably circular in shape and a hinge 18 provides a seat pivot for rotatably secures the seat 16 to the bowl 14. Four legs 20 are secured to the bowl 14 to support the bowl 14 and the seat 16 in an upright position for use. The legs 20 have upper portions 22 fixedly secured to the bowl 14 and lower portions 24 which telescopically extend beneath the upper portions 22. Crossbars 32 extend between the lower portions of the legs 20. Locks 26 are provided for selectively securing the lower portions 24 of the legs 20 in fixed relation to the upper portions 22 and the bowl 14. The locks 26 for controlling telescopic extension of the legs 20 are preferably connected together by cables 58 to a lever 54, such that operating of the lever 54 automatically controls actuation and release of all four of the locks 26 at the same time. Wheels 28 are provided on the lower portions 24 of the legs 20, and preferably are provided by castor wheels having stops 30 which are selectively operated to prevent the wheels 28 from rotating when the portable toilet 12 is disposed in a selected position. The legs 20 are preferably spaced apart at least either from side-to-side, or from front-to-front, to fit a conventional building toilet 60 there-between.

A seat body 56 provides a primary platform for the entire chair 12. Mounted beneath the seat body 56 are two arm tubes 116, each extending transversely across the seat body 56. The arm tubes 116 are spaced apart, within one extending across the rear of the set body 56 and the other extending across the front of the seat body 56, flush against the bottom of the seat body 56 and against respective ones of the legs 22. The arm tubes 116 are preferably welded to respective ones of the upper portions 22 of the legs 20. The arm tubes 116 are preferably formed tubes having U-shaped upper ends with lower ends that are turned transversely to a plane of respective ones of the upper ends for extending in parallel and fitting into respective ones of the arm tubes 116. The two arms 118 are mounted on opposite sides of the portable toilet 12 when received within respective ones of the arm tubes 116. The arm tubes 116 and the arms 118 have apertures for receiving fastening pins to secure the arms 118 in place within the arm tubes 116. Mounted to the rearward sides of the upper portions 22 of the rearward-most ones of the legs 20 are two backrest mounting tubes 120, one mounted to each of the rearward-most legs 20. Preferably, the backrest mounting tubes 120 are welded to respective ones of the upper portions 22 of the rear legs 20. A backrest 122 is provided by a formed tube having an upper portion which is U-shaped and two terminal ends which turn transversely to a plane of the upper U-shaped portion for fitting within respective ones of the backrest mounting tubes 120. Preferably, the two terminal ends of the backrest 122 and the backrest mounting tubes 122 each have holes 124 for receiving the fastening pins 125 to secure the backrest 122 to the backrest mounting tubes 120 to secure the backrest 122 extending upward from the rearward end of the seat base 56.

Figure 2:
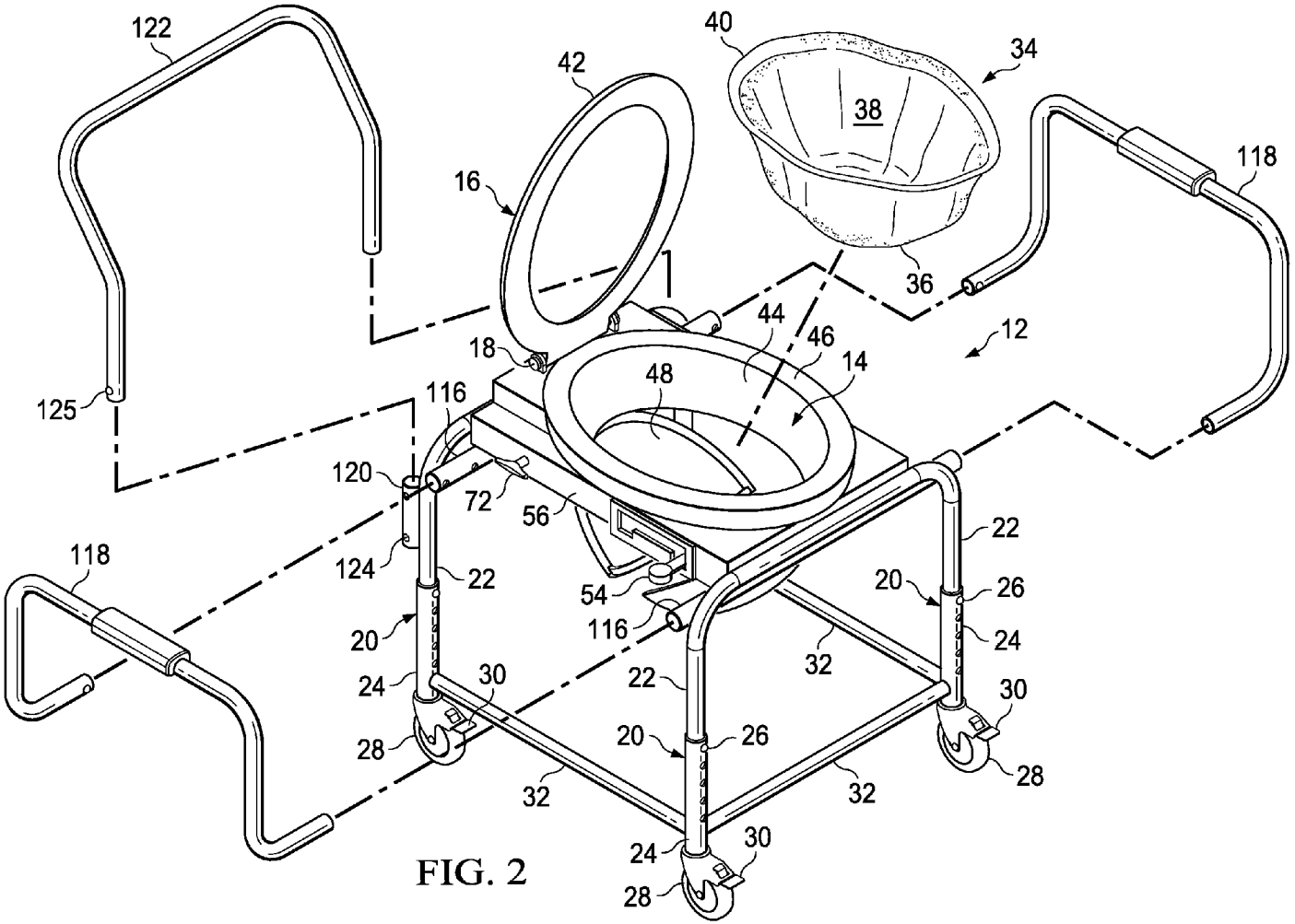

FIG. 2 is a partially exploded, perspective view of the portable toilet 12 and a liner 34 for fitting within the bowl 14. The liner 34 is provided to prevent the inside of the bowl 14 from becoming soiled during use. The liner 34 has an enclosed lower portion 36, an open upper end 38, and a periphery 40 extending about the open upper end 36. The periphery 40 preferably extends fully around the open upper end 38 of the liner 34. The liner 34 is sized for fitting flush against the interior of the bowl 14, with the periphery 40 fitting along a rim 46 of the bowl 14. The liner 34 is preferably formed of paper which will contain waste and also be allowed for disposal in the conventional building toilet 60. The seat 16 has a bottom surface 42 configured fitting flush against the rim 46 of the bowl to secure the periphery 40 there-between until the seat 16 is moved to a raised position. The bottom surface 42 may be flat and the entire bottom surface 42 may fit flush against the rim 46, and in other embodiments protrusions or recesses may define part of the bottom surface 42 for fitting flush against the rim 46 to hold the liner 34 in place until the seat 16 is lifted to the raised position. The bowl 14 has an upper end 44 and lower end 48. The upper end 44 of the bowl 14 defines the rim 46, which is preferably a flat surface. In some embodiments, the rim 46 may have protrusions and/or recesses.

Figure 3:
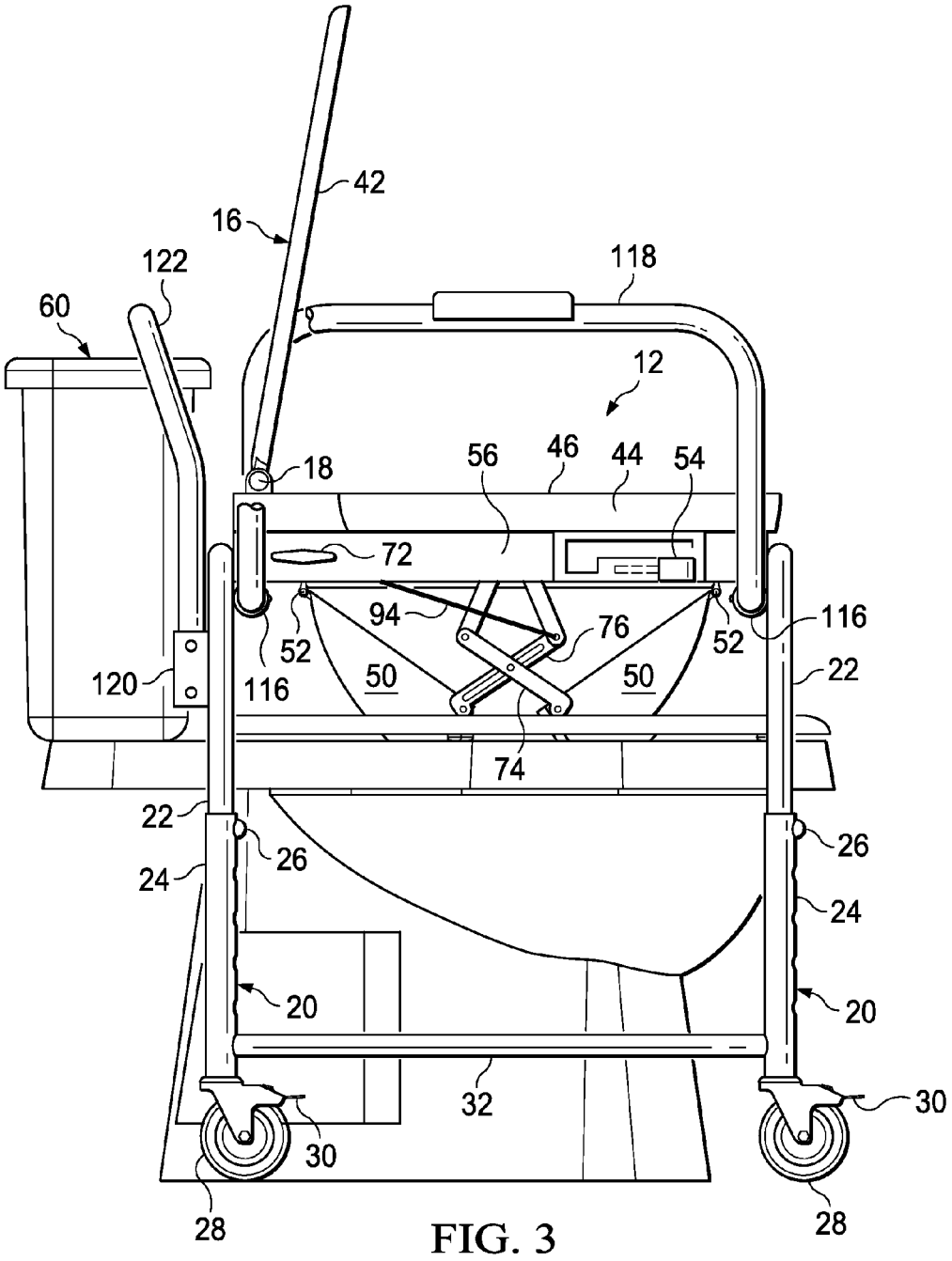

FIG. 3 is a partial cutaway, side elevation view of the portable toilet 12 being positioned above a conventional building toilet 60 showing the legs 20 telescopically extended and the seat 16 raised. The lower end 48 of the bowl preferably has a sections 50 which are movably secured to the upper end 44 of the bowl at pivot points defined by spring hinges 52. The spring hinges 52 bias the sections 50 into the closed positions shown in FIGS. 1 and 7, until the sections are pulled to open positions as shown in FIGS. 2-6 and 8. Preferably there are two moveable sections 50, but in other embodiments one or more than two sections 50 may be provided. Pulling on the handle 72 will open the sections 50 of the lower end 48 of the bowl 14.

Figure 4:
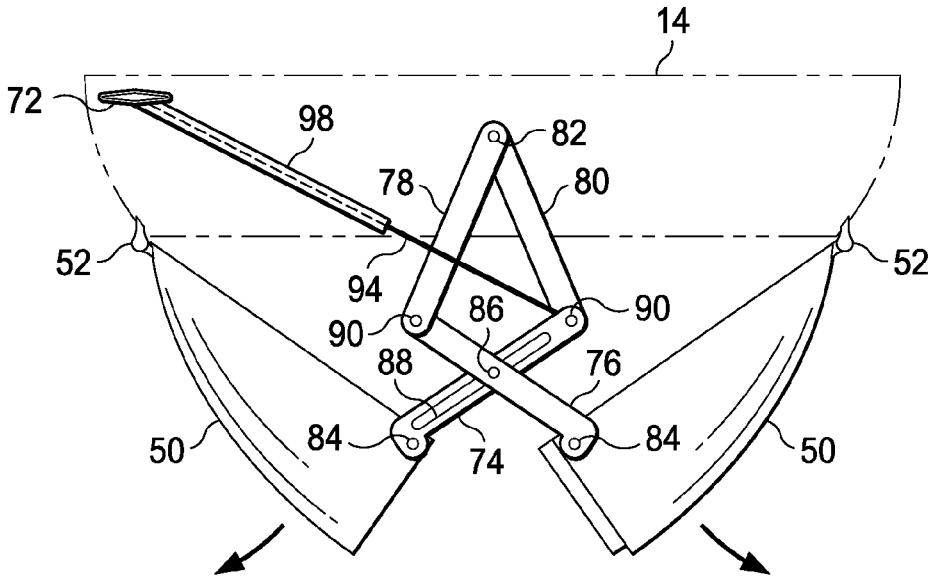
Figure 7:
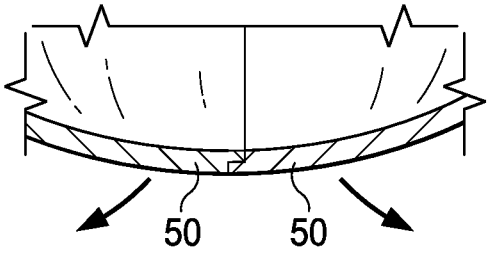

FIG. 4 shows a schematic side elevation view of the bowl 14 with the pull handle 72 for opening and closing the lower sections 50 of the bowl 14. The linkages 74, 76, 78 and 80 are pivotally connected in the arrangement shown with a fixed pivot point 82 connecting together upper ends of the linkages 78 and 80. A lower end of the linkage 78 is pivotally connected to an upward end of the linkage 76, and a lower end of the linkage 80 is pivotally connected to an upper end of the linkage 74, at free floating pivot points 90. The linkages 74 and 76 cross and lower terminal ends of each of the linkages 74 and 76 are connected to respective ones of the bowl sections 50 at pivot points 84. The pivot points 84 are fixed in position relative to each of the respective ones of the bowl sections 50, in a pivotally connected arrangement. A slider pin 86 is provided for pivotally connecting and slidably being received within a slot 88 in the link 74, with the slider pin 86 being in fixed pivotal connection relative to the link 76. A cable 94 provides a flexible link which extends from the one of the pivot points 90 connecting the links 74 and 80 together, up through a guide tube 98 and to the pull handle 72. Preferably, the spring hinges 52 spring load the lower sections 50 of the bowl 14 into the closed positions as shown in FIGS. 1 and 7, until the pull handle 72 is pulled outward and away from the bowl 14 to move the lower sections 50 and open the bowl 14. Pulling the handle 72 outward will pull the pivot pin 90 located between the linkages 74 and 80 toward the pull handle 72. When the pull handle 72 is released, the spring hinges 52 close the lower sections 50 of the bowl 14.

Figure 5:
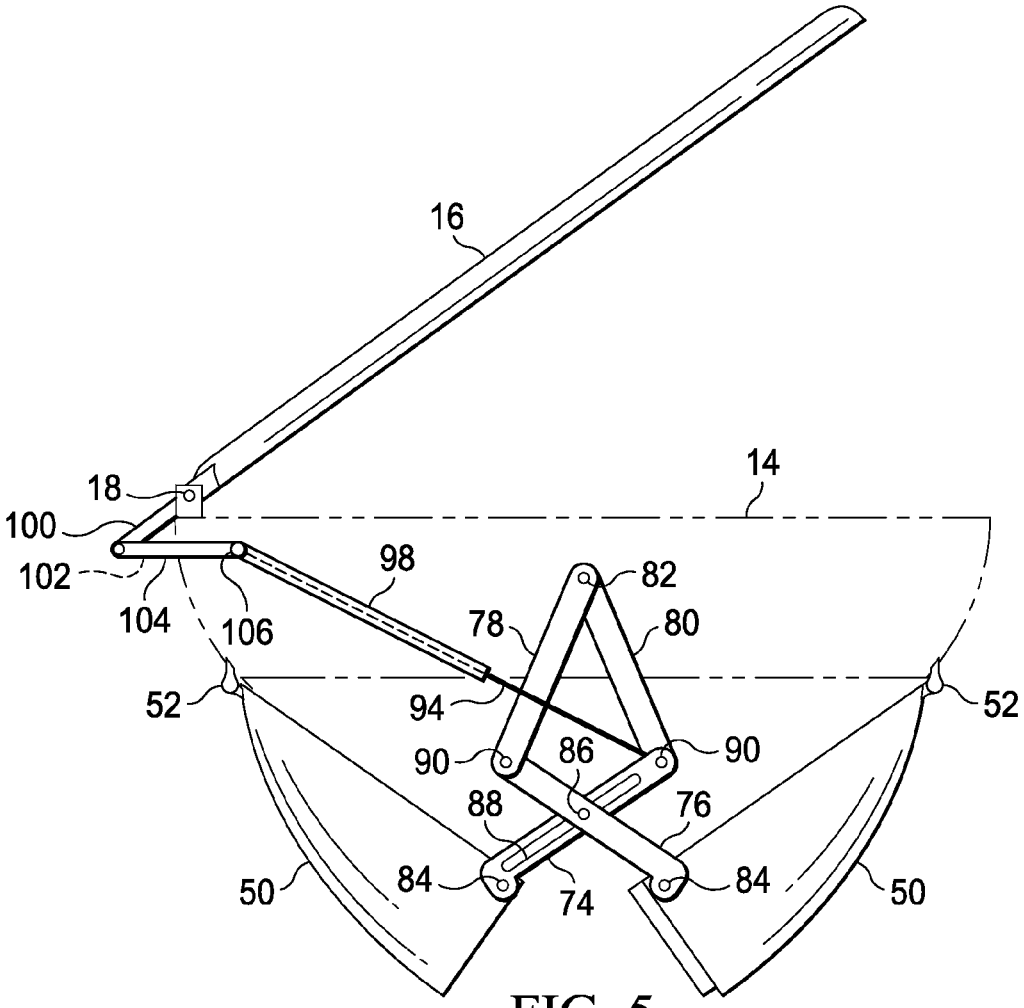
Figure 6:
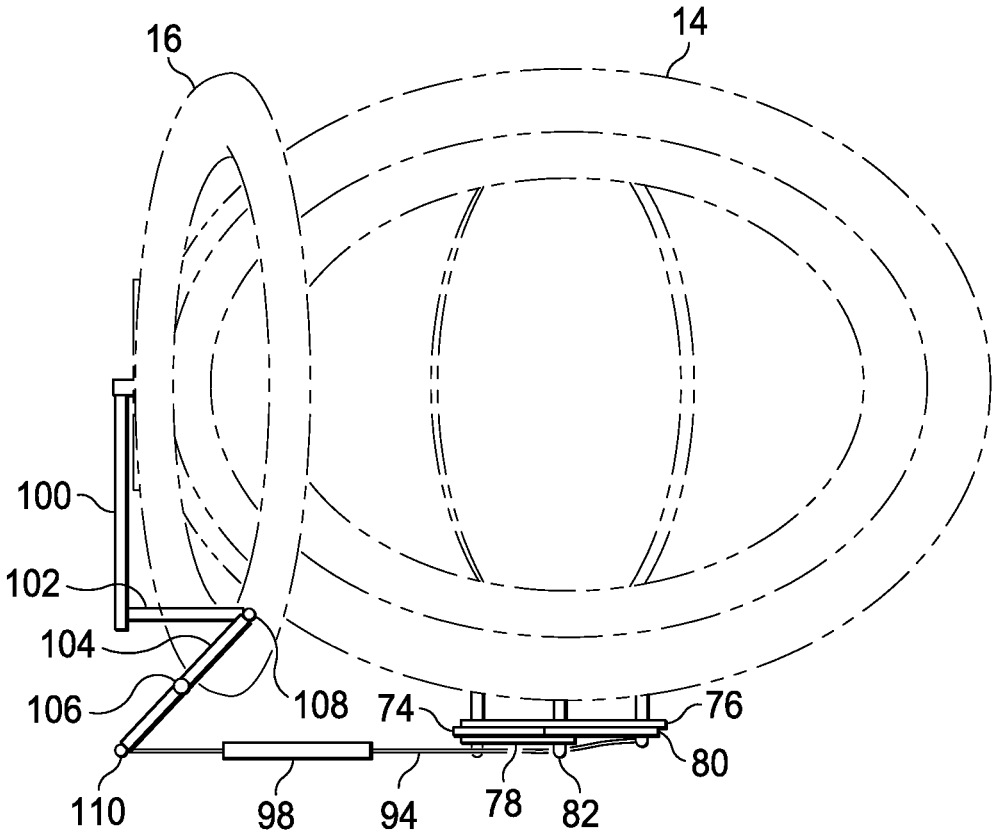

FIGS. 5 and 6 show linkages 102 and 104 for connecting to cable 95 and to the linkages 74 through 80 for automatically closing and opening the bowl sections 50 in response to lowering the seat 16 and raising the seat 16, respectively. The linkage 104 is pivotally connected to a fixed pivot point 106 and rotates about the pivot point pin 106. A first end of the linkage 104 is connected to the end of the cabling 94 at a free floating pivot pin 110. The cable 94 extends through the guide tube 98. The opposite end of the linkage 104 is pivotally connected to a linkage 102 at a free floating pivot pin 108. The opposite end of the linkage 102 that is connected to the linkage 104 is connected to an extension 100 defining a lower terminal end of the seat 16. The linkages 104 and 102 are connected to the end of the seat extension 100 such that raising the forward end of the seat 16 upwards to open the seat 16 will cause the lower end of the seat 100 to push the linkage 102, rotating the linkage 104 about the pivot pin 106, causing the first end of the linkage 104 to pull on the cable 94 and automatically open the lower sections 50 of the bowl 14 against the force of the spring hinges 52. Lowering the forward end of the seat 16 downward to place the seat 16 in a closed position will then cause the lower end 100 of the seat 16 to pull on the linkage 102, rotating the linkage 104 to release the cable 94 and allow the spring hinges 52 to close the lower sections 50 of the bowl 14.

FIG. 7 is a sectional view of mating sections 50 of the lower end 48 of the bowl 14, shown in closed positions.

Figure 8:
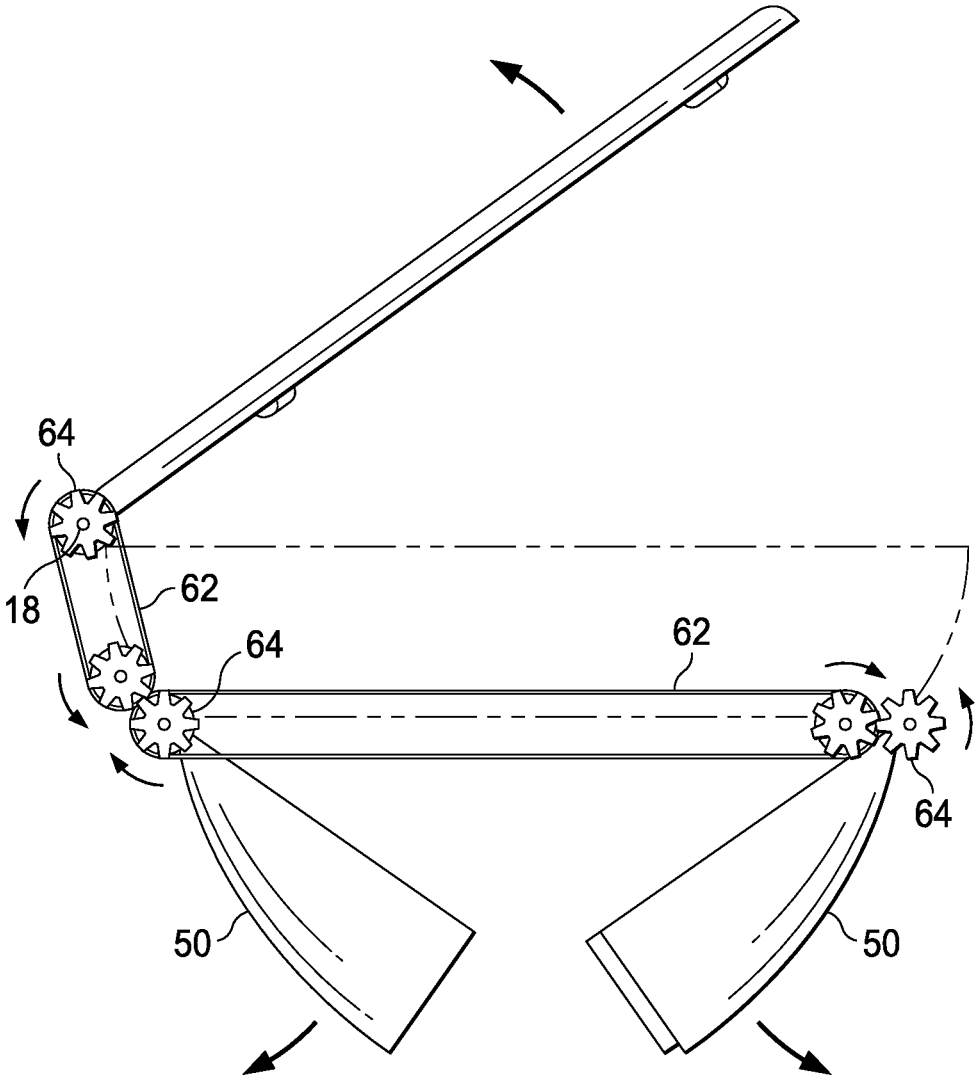

FIG. 8 is a side elevation view of an alternative embodiment of the portable toilet 12, in which opening the seat 16 automatically opens the sections 50 of the bowl 14 using a configuration of two belts 62 and 5 sprockets 64. The belts 62 extend around sprockets 64 for moving sections 50 between open and closed positions in response to the seat 16 being moved between upward and downward positions. Three of the sprockets 64 are preferably non-rotatably secured to respective ones of the seat 16, and the two sections 50. Two of the sprockets 64 are rotatably secured to the seat body 56 and the upper end 44 of the bowl 14. In some embodiments cogged belts may be used for the two belts 62, and in other embodiments chains may be used to replace the belts 62 with gears replacing the sprockets 64.

Figure 9:
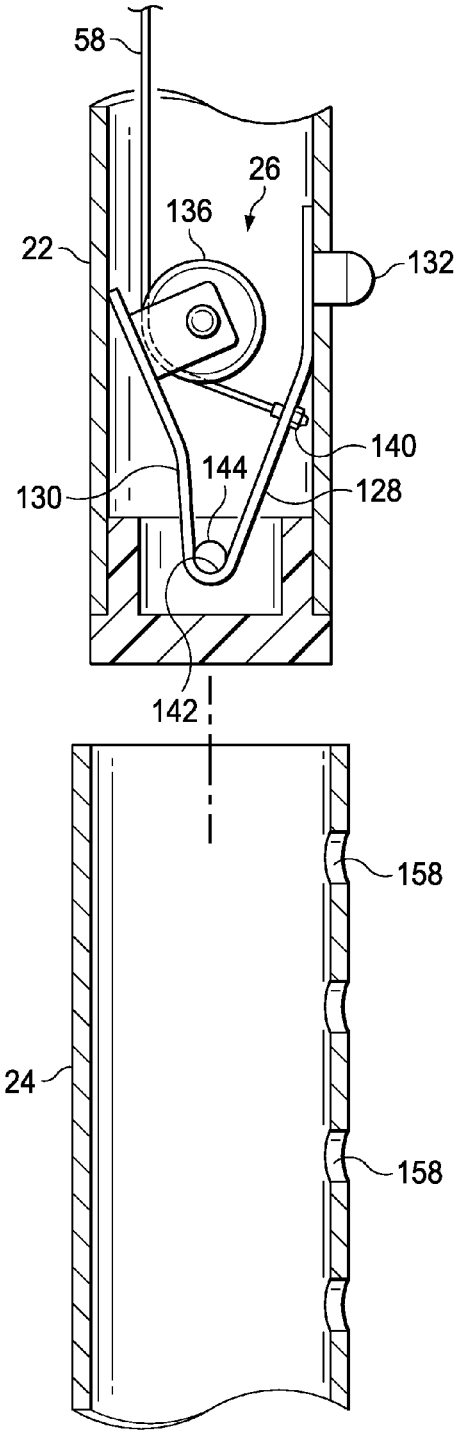
Figure 10:
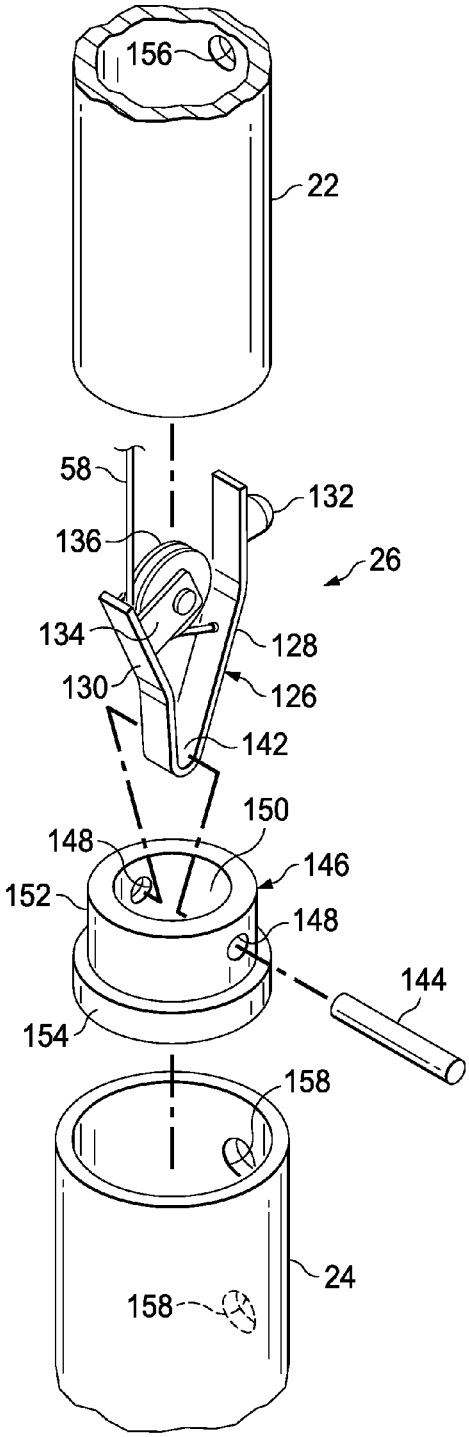

FIGS. 9 and 10 show various components for the locks 26 for securing the upper portions 22 and the lower portions 24 together of the legs 20 together in a telescopic arrangement. The cables 58 are provided for connecting the various locks 26 together with the lever handle 54 for selectively releasing all of the locks 26 at one time. Each of the locks 26 preferably has a generally v-shaped bracket 126 disposed within the lower ends of each of the upper portions 22 of the legs 20. The V-shaped bracket 126 has a first leg 128 from which extends a lock pin 132, and a second leg 130 to which a pulley 136 is mounted. The second leg 130 has two mounting bosses 134 extending laterally therefrom for pivotally securing the pulley 136 in a rotary arrangement. The cable 58 extends downward through the pulley 136 and then turns around the pulley and extends through an aperture in the mid portion of the leg 128 and then is secured by a crimp 140. This is provided such that when the cable 58 is pulled upwards and the lower end portion 142 of the V-shaped bracket 126 is held in position, the leg 128 will pull inward towards the second leg 130 and remove the lock pin 132 from within one of the detent holes 158 in the lower portions 24 of the legs 20. The lower end of the V-shaped bracket 126 defines a retainer end 142 which is U-shaped and secured in a lower end of the leg section 22 by a fastener pin 144 located within an end plug 146.

The end plug 146 abuts the lower terminal end of the upper portion 22 of the leg 20. Apertures 148 extend through the end plug 146 for receiving a fastener pin 144. A recess 150 defines a cavity in the upward end of the end plug 146 which is sized such that the retainer end 142 of the V-shaped bracket 126 will fit therein a sufficient depth for the fastener pin 144 to extend across an upper portion of the retainer end 142 and retain the V-shaped bracket 126 within the end plug 146. The outer diameter 152 of an upper portion of the end plug 146 is smaller than the annular-shaped flange end 154 on the lower portion of the end plug 146. The annular-shaped flange 154 is sized such that it will not fit within the upper portion 22 and will extend slightly beyond the terminal end of the upper portion 22 to provide an annular-shaped bearing surface for engaging within an interior surface of the lower portion 24 of the leg 20. Thus, the end plug 146 also provides a bearing for interfitting between the upper portion 22 and the lower portion 24 in the slidably engaging telescopic arrangement. A singular lock pin hole 156 is provided in the upper portion 22 for receiving the lock pin 132 of the leg 128 of the V-shaped bracket 126 in a sliding arrangement. Detent holes 158 are provided in linear alignment longitudinally along one side of the lower portion 24 of the leg 20 for selectively engaging with the lock pin 132 to fix the upper portion 22 and the lower portion 24 in selective telescopic extension alignment.

Figure 11:
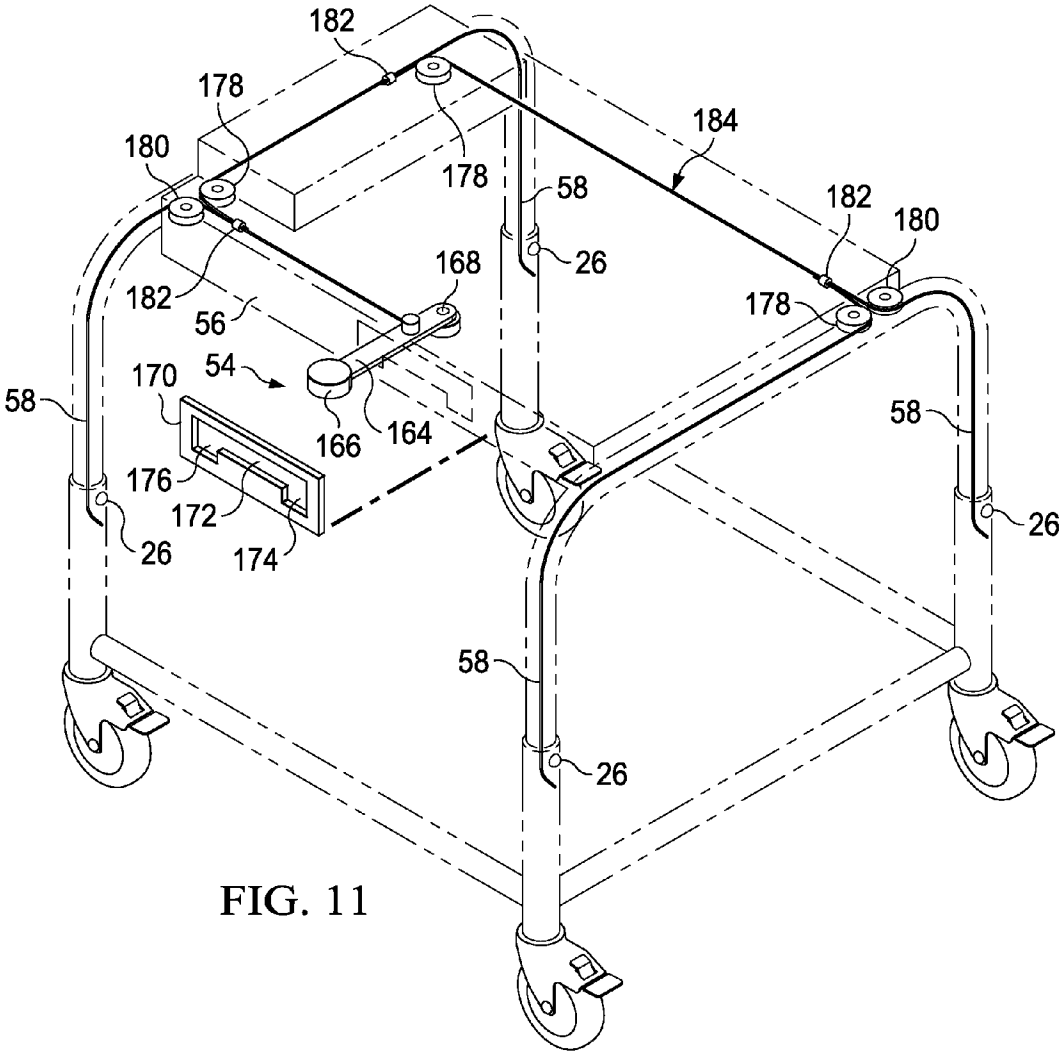

FIG. 11 is a schematic diagram showing a perspective view of the portable toilet 12, showing arrangement of the cabling 58 for connecting each of the locks 26 in operative arrangement. The lever 54 comprises a lever arm 164 having an outward end which defines a grip knob 166 and in inward portion which pivotally connected to a pivot pin 168. A guide plate 170 is provided for guiding movement of the lever arm 164 during operation. The guide plate 170 has a guide slot 172 which is U-shaped, having a free position recess 174 on a first end and a lock position recess 176 on a second end. Preferably, when the lever 54 is disposed in the lock position recess 174, the upper portions 22 will be locked in selective telescopic position relative to the lower portions 24 of the legs 20 by the lock pin 132 extending through a selected one of the detents 158 for each of the legs 20. Then, when the lever 54 is moved to the free position recess 176, the cable 58 of FIG. 9 will pull upwards on the v-shaped bracket 126, causing the first leg 128 to move toward the second leg 130 of the V-shaped bracket 126, and removing the lock pin 132 from within respective ones of the detent holes 158 in the lower portions 24, freeing the upper portion 22 to move telescopically relative to the lower portion 24. Guide pulleys 178 and 180 are shown for running the cables 58 from the locks 26 to the lever 54, such that movement of the lever will retract the lock pins 132 of each of the legs 20. The cabling 58 is preferably provided by a cable harness 184 formed by joining ends or respective ends of the cables 58 to mid-sections of adjacent ones of the cables 58 with crimps 182. This provides for ease of assembly, such that only a single strand of cable 58 runs for various lengths in extending between the four leg locks 26 and the lever 54, except for short sections adjacent to the guide pulleys 178 and 180.

Preferably, the bowl 14, the seat 16 and the seat body 56 are formed of plastic. The legs 20, cross bars 32, the arm tubes 116, the arms 118, the backrest mounting tubes 120, and the backrest 122 are preferably formed of aluminum tubing. The liner 34 is preferably formed of paper which will prevent moisture from seeping through, yet be suitable for disposal in a conventional building toilet 60 without disrupting building plumbing. The V-shaped bracket 126 is preferably formed of spring steel. The end plug 146 is preferably formed of a plastic, such as Teflon, which will provide a suitable bearing between the leg portions 22 and 24.

In operation, an attendant or care giver will preferably place the liner 34 within the bowl 14 of the portable toilet 12 and place the seat 16 in the lowered position to grip the periphery of the liner between the seat 16 and the rim 46 of the bowl 14. The bowl sections 50 will be retained in closed positions by the spring hinges 52 to enclose the lower end of the bowl 14. After use, the legs 20 are extended by the care giver stepping on one of the crossbars 32, moving the lever 54 to a release position in the slot 174, and then pulling upward on the seat body 56 until the bowl 14 and the seat 16 is raised to a desired position. The lever 54 will then be moved to a locked position in the slot 176 to lock the legs 20 in the extended positions. The portable toilet 12 is then moved to locate the bowl 14 above the conventional building toilet 60. The pull handle 72 is pulled to move the bowl sections 50 and open the lower end of the bowl 14. The seat 16 is then to release the liner 34 and its contents to falling from the bowl 14 into the conventional toilet 60.

The present invention provides a portable toilet having a bowl with a lower end which will open to spill the contents from the bowl into a conventional building toilet. A liner is provided in the bowl which is held in place when the seat is lowered and released for spilling from the bowl when the seat is raised and the lower end of the bowl is opened. This allows an attendant or care giver to spill the contents of the bowl without having to touch the bowl or the liner for removal from the portable toilet. The contents of the liner will automatically spilling from the portable toilet into a conventional building toilet.

Although the preferred embodiment has been described in detail, it should be understood that various changes, substitutions and alterations can be made therein without departing from the spirit and scope of the invention as defined by the appended claims.

What is claimed is:

1. A portable toilet having a bowl, a seat which is pivotally mounted to the bowl, and legs which support the bowl and the seat in a upright position, the improvement comprising:

the bowl having an upper end and a lower end, wherein said lower end is defined by at least one section which is moveable relative to said upper end from a closed position, enclosing said lower end of the bowl and retaining contents of the bowl within the bowl, to an open position, exposing said lower end of the bowl for spilling the contents therefrom;

the bowl further having a rim disposed along a topside of said upper end of the bowl;

the seat having a bottom surface configured for engaging against said rim; and a plurality of linkages extending between a pull handle and said at least one section for moving said at least one section from a closed position to an open position in response to pulling the pull handle.

2. The portable toilet according to claim 1, further comprising legs being telescopically extensible and spaced apart for positioning the bowl above a conventional building toilet.

3. The portable toilet according to claim 2, further comprising locks for securing said legs in selected lengths, wherein said locks each comprise a bracket having a lock pin for extending through an aperture in an upper portion of a respective one of said legs and into a detent in a lower portion of said respective one of said legs, and a cable secured between said bracket and a lever for moving said lever to pull said cable and said lock pin such that said lock pin is moved within said aperture and from said detent and said lower portion of said leg is released for moving relative to said upper portion of said leg, wherein each of said locks has said cable connected between said lever for moving in response to said lever moving.

4. The portable toilet according to claim 3, wherein said bracket for each of said locks are formed of spring steel and comprises a first leg and a second leg, said first having said lock pin extending therefrom and second leg having a mounting boss for pivotally securing a pulley thereto, wherein said cable extends around said pulley and is secured to said first leg such that pulling on said cable will pull said first leg toward said second leg and move said lock pin within said aperture.

5. The portable toilet according to claim 1, further comprising at least one linkage extending between the seat and said at least one section for moving said at least one section from a closed position to an open position in response to the seat moving from a lowered position to a raised position.

6. A portable toilet comprising:

a bowl having an upper end a lower end, said upper end having a rim defining a topside of said bowl, and said lower end defined by at least one section which is moveable relative to said upper end from a closed position, enclosing said lower end of said bowl and retaining contents of said bowl within said bowl, to an open position, exposing said lower end of the bowl for spilling the contents therefrom;

a seat pivotally mounted to said bowl for moving between a lower position, resting on said rim of said bowl, and a raised position lifted from atop said rim of said bowl, wherein said seat has a bottom surface configured for engaging against said rim of said bowl;

legs which support the bowl and the seat in a upright position; and locks for securing said legs in selected lengths, wherein said locks each comprise a bracket having a lock pin for extending through an aperture of a respective one of said legs and into a detent of a lower portion of said respective one of said legs, and a cable secured between said bracket and a lever for moving said lever to pull said cable and said lock pin such that said lock pin is moved within said aperture and from said detent and said lower portion of said leg is released for moving relative to said upper portion of said leg, wherein each of said locks has said cable connected between said lever for moving in response to said lever moving.

7. The portable toilet according to claim 6, further comprising said legs being telescopically extensible and spaced apart for positioning the bowl above a conventional building toilet.

8. The portable toilet according to claim 6, further comprising a lock for securing said legs in selected lengths.

9. The portable toilet according to claim 6, wherein said bracket for each of said locks are formed of spring steel and comprises a first leg and a second leg, said first having said lock pin extending therefrom and second leg having a mounting boss for pivotally securing a pulley thereto, wherein said cable extends around said pulley and is secured to said first leg such that pulling on said cable will pull said first leg toward said second leg and move said lock pin within said aperture.

10. The portable toilet according to claim 6, further comprising at least one linkage extending between the seat and said at least one section for moving said at least one section from a closed position to an open position in response to the seat moving from a lowered position to a raised position.

11. The portable toilet according to claim 6, further comprising a plurality of linkages extending between a pull handle and said at least one section for moving said at least one section from a closed position to an open position in response to pulling the pull handle.

12. A portable toilet comprising:

a seat base;

a bowl mounted to said seat base, said bowl having an upper end a lower end, said upper end having a rim defining a topside of said bowl, and said lower end defined by a plurality of sections which are moveable relative to said upper end from a closed position, enclosing said lower end of said bowl and retaining contents of said bowl within said bowl, to an open position, exposing said lower end of the bowl for spilling the contents therefrom;

a plurality of linkages, a first two of said linkages connected between a first one of said plurality of sections and an upper end of said bowl, and a second two of said linkages connected between a second one of said plurality of sections and said upper end of said bowl, wherein at least one of said first two of said linkages and one of said second two of said linkages are pivotally connected together;

a handle mounted to said seat base, said handle connected to said plurality of linkages such that movement of said pull handle urges movement of said linkages and moves at least one of said plurality of sections to open said lower end of said bowl;

a seat pivotally mounted to said seat base for moving between a lower position, resting on said rim of said bowl, and a raised position lifted from atop said rim of said bowl, wherein said seat has a bottom surface configured for engaging against said rim of said bowl;

legs which support the bowl and the seat in a upright position, said legs being telescopically extensible and spaced apart for positioning the bowl above a conventional building toilet; and a plurality of locks for securing said legs in selected lengths.

13. The portable toilet according to claim 12, further comprising locks for securing said legs in selected lengths, wherein said locks each comprise a bracket having a lock pin for extending through an aperture in an upper portion of a respective one of said legs and into a detent hole in a lower portion of said respective one of said legs, and a cable secured between said bracket and a lever for moving said lever to pull said cable and said lock pin such that said lock pin is moved within said aperture and from said detent hole and said lower portion of said leg is released for moving relative to said upper portion of said leg, wherein each of said locks has said cable connected between said lever for moving in response to said lever moving.

14. The portable toilet according to claim 13, wherein said bracket for each of said locks are formed of spring steel and comprises a first leg and a second leg, said first having said lock pin extending therefrom and second leg having a mounting boss for pivotally securing a pulley thereto, wherein said cable extends around said pulley and is secured to said first leg such that pulling on said cable will pull said first leg toward said second leg and move said lock pin within said aperture.

15. The portable toilet according to claim 14, further comprising:

two seat tubes mounted beneath said seat base and secured to respective ones of upper portions of said legs, said two seat tubes spaced apart and extending transverse to said set base; and two arms formed of U-shaped tubes having terminal ends which fit within respective open ends of said two seat tubes.

* * * * *